US009439471B2

(12) United States Patent
Wehtje

(10) Patent No.: US 9,439,471 B2
(45) Date of Patent: Sep. 13, 2016

(54) METHOD OF USING A REPLACEABLE-COMPONENT HELMET

(76) Inventor: Erik W. Wehtje, Sarasota, FL (US)

( * ) Notice: Subject to any disclaimer, the term of this patent is extended or adjusted under 35 U.S.C. 154(b) by 0 days.

(21) Appl. No.: 13/212,578

(22) Filed: Aug. 18, 2011

(65) Prior Publication Data

US 2013/0042396 A1 Feb. 21, 2013

(51) Int. Cl.
*A42B 3/32* (2006.01)
*A42B 3/20* (2006.01)

(52) U.S. Cl.
CPC .. *A42B 3/32* (2013.01); *A42B 3/20* (2013.01)

(58) Field of Classification Search
CPC ..... A42B 3/20; A42B 3/32
USPC ..... 2/411, 425
See application file for complete search history.

(56) References Cited

U.S. PATENT DOCUMENTS 2,604,630 A * 7/1952 Waring ..... 2/209.11
2,855,604 A * 10/1958 Austin ..... 2/416
3,445,860 A 5/1969 Rodell
4,918,752 A 4/1990 Briggs
4,955,089 A * 9/1990 Beale ..... 2/410
4,996,724 A * 3/1991 Dextrase ..... 2/411
5,093,936 A 3/1992 Copeland et al.
6,138,283 A * 10/2000 Kress ..... 2/411
6,983,488 B2 * 1/2006 Foote et al. ..... 2/10
7,096,513 B1 * 8/2006 Kress ..... 2/410
7,308,721 B1 * 12/2007 Rivera, Jr. ..... 2/207
8,166,573 B1 * 5/2012 Chung et al. ..... 2/411
2002/0120978 A1 * 9/2002 Moore, III ..... 2/412
2004/0003452 A1 * 1/2004 Schiebl ..... 2/421
2004/0025229 A1 * 2/2004 Takahashi et al. ..... 2/412
2007/0094769 A1 * 5/2007 Lakes et al. ..... 2/171.3
2009/0044316 A1 2/2009 Udelhofen
2009/0126062 A1 * 5/2009 Bengochea ..... 2/10
2009/0222976 A1 * 9/2009 Loury et al. ..... 2/411

* cited by examiner

*Primary Examiner* — Katherine Moran
(74) *Attorney, Agent, or Firm* — Fitzpatrick, Cella, Harper & Scinto

(57) ABSTRACT

A helmet includes a frame component and a detachable, replaceable head-protection component. The frame component includes a facemask and a chin strap attachment. The head-protection component is attached to the frame component by mating respective connectors disposed on each component. Upon an impact, the damaged head-protection component may be removed and replaced with a new replacement head-protection component.

14 Claims, 7 Drawing Sheets

METHOD OF USING A REPLACEABLE-COMPONENT HELMET

FIELD OF THE INVENTION

The present invention relates to a two-component helmet with a frame component and a detachable, replaceable head-protection component.

BACKGROUND OF THE INVENTION

Head injuries are of great recent concern in contact sports such as football. Concussions suffered by football athletes have resulted in long-term brain damage and even occasionally death. It has been realized that a greater level of head protection is necessary to protect athletes from such injuries.

Traditional helmets, and in particular sports helmets, are designed with a compromise between durability and protection. Since athletes infrequently replace sports helmets, the helmets are traditionally designed to continuously absorb numerous impacts without losing their protective qualities.

Sports helmets, such as football helmets, are customarily constructed with an outer hard shell layer, various shock absorption layers, and an inner padded layer that contacts an athlete's head. The outer hard shell layer does not easily deform, thus allowing the helmet to maintain its structure despite repeated hits. Thus, the helmet may often be used for years without replacement. However, because of the trade-off in durability, the outer hard shell layer suffers in its abilities to absorb and disperse the force from an impact.

Bicycle helmets, on the other hand, are designed differently from sports helmets. Since head impacts are not a common occurrence when bicycling, bicycle helmets are designed to deform on impact and spread the force of an impact across a larger area, thus providing a greater level of protection. However, upon a significant impact, a bicycle helmet is permanently damaged and loses its protective functions. Thus, a damaged bicycle helmet cannot be re-used and must be replaced.

As such, a need exists in the field of sports helmets for a helmet which provides improved protection for head impacts, using more absorbent materials. However, frequent replacement of such a football helmet may be prohibitively expensive for many athletes.

Accordingly, a need exists in the field of sports helmets for a cost-effective helmet that provides improved protection for head impacts through the use of more force absorbent and dispersive materials.

SUMMARY OF THE INVENTION

In one aspect, the present invention relates to a helmet comprising a head-covering portion (i.e., crown portion) that, rather than being made of a rigid or hard material, is made of a deformable or impact disbursing material. The head-covering portion includes at least one connector; and a frame portion, said frame portion including at least one connector and adapted to support said head-covering portion, wherein said at least one connector of said frame portion mates with said at least one connector of said head-covering portion to releasably attach said frame portion to said head-covering portion.

In another aspect, the present invention relates to a helmet comprising a frame portion, said frame portion including at least one connector and adapted to support a head-covering portion, wherein said at least one connector of said frame portion mates with at least one connector on the head-covering portion to releasably attach said frame portion with the head-covering portion.

In yet another aspect, the present invention relates to a helmet comprising a head-covering portion which is made of a deformable or impact disbursing material, said head-covering portion including at least one connector and adapted to be attached to a frame portion, wherein said at least one connector of the frame portion mates with said at least one connector of said head-covering portion to releasably attach the frame portion with said head-covering portion.

In another aspect, the present invention relates to a method of using a helmet, comprising attaching a first head-covering portion, which is made of a deformable or impact disbursing material, to a frame portion, by mating at least one connector on the first head-covering portion with at least one connector on the frame portion; activating a user control to detach the first head-covering portion from the frame portion, wherein the user control releases from or un-mates the at least one connector of the first head-covering portion from the at least one connector of the head-covering portion; and attaching a second head-covering portion to the frame portion, by mating at least one connector on the second head-covering portion with the at least one connector on the frame portion, thereby replacing the first head-covering portion.

DETAILED DESCRIPTION OF THE PREFERRED EMBODIMENTS

First Embodiment

Figure 1:
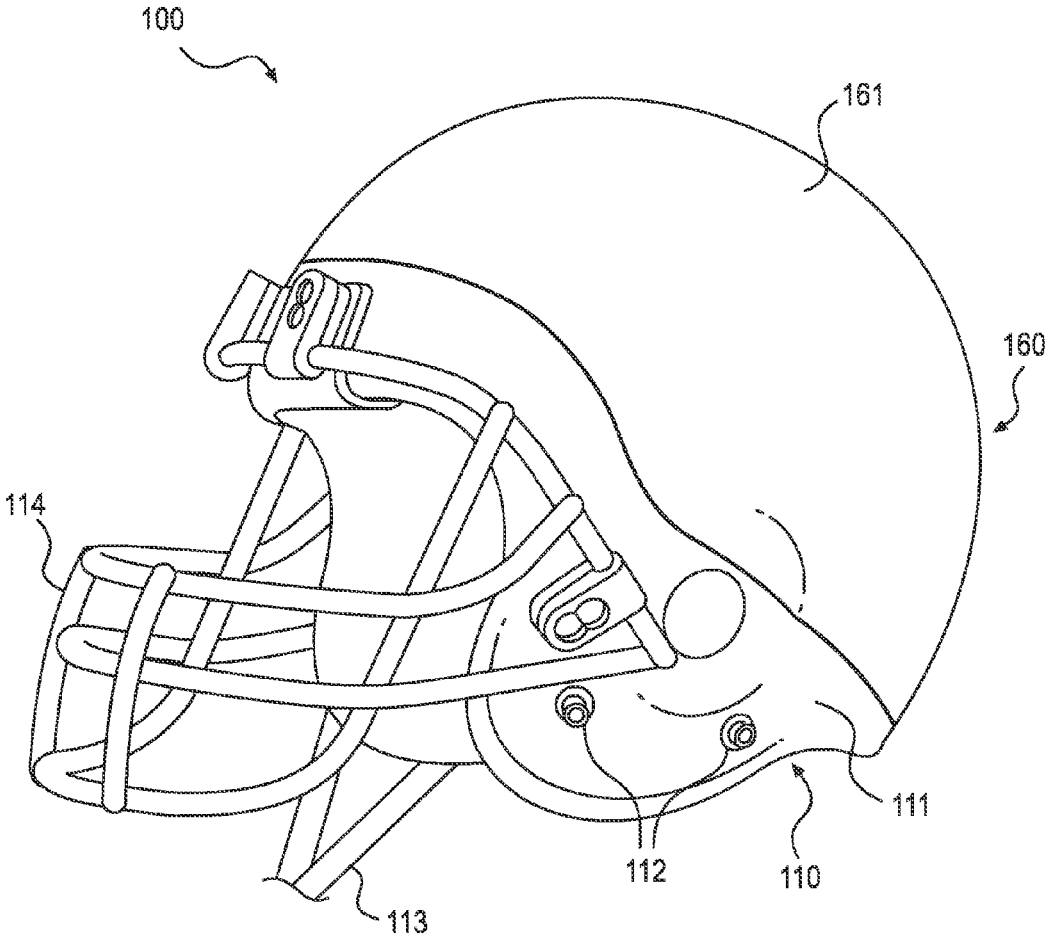
FIG. 1 is a side view of a helmet in accordance with a first embodiment of the present invention, with a head-protection or first head-covering component attached to a frame or second head-covering component.
Figure 2:
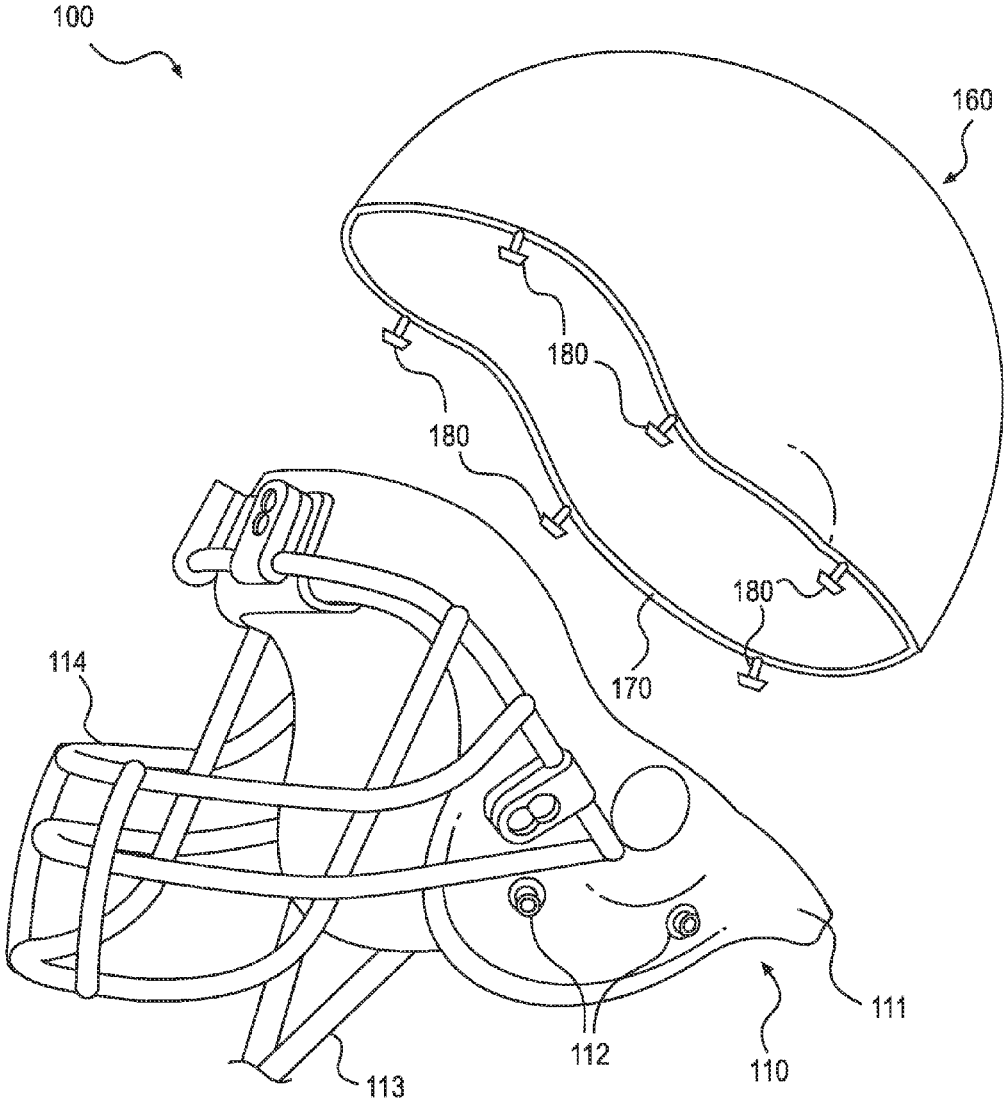
FIG. 2 is a side view of the helmet, with the head-protection component detached from the frame component.
Figure 3:
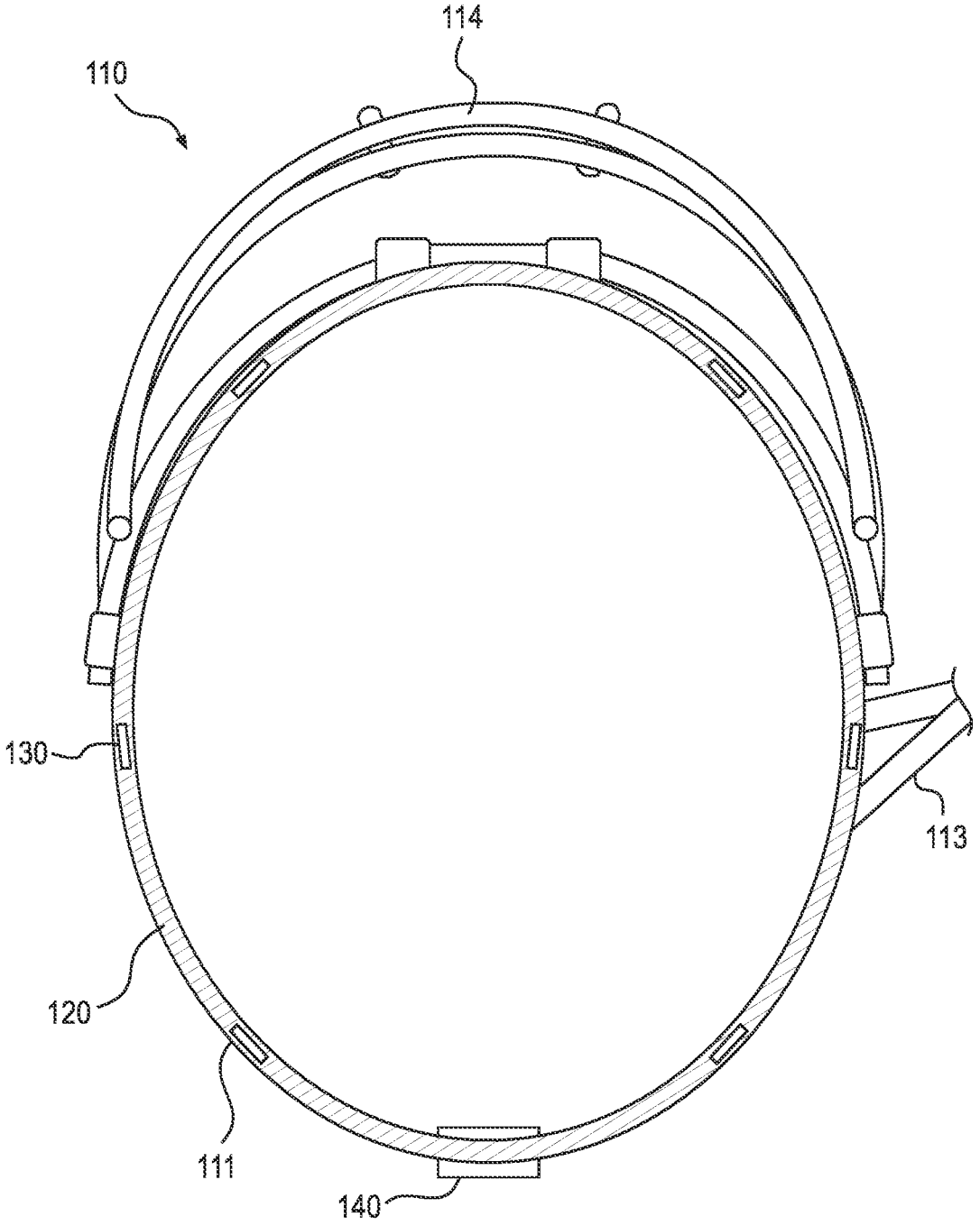
FIG. 3 is an overhead view of the frame component of the helmet.
Figure 4:
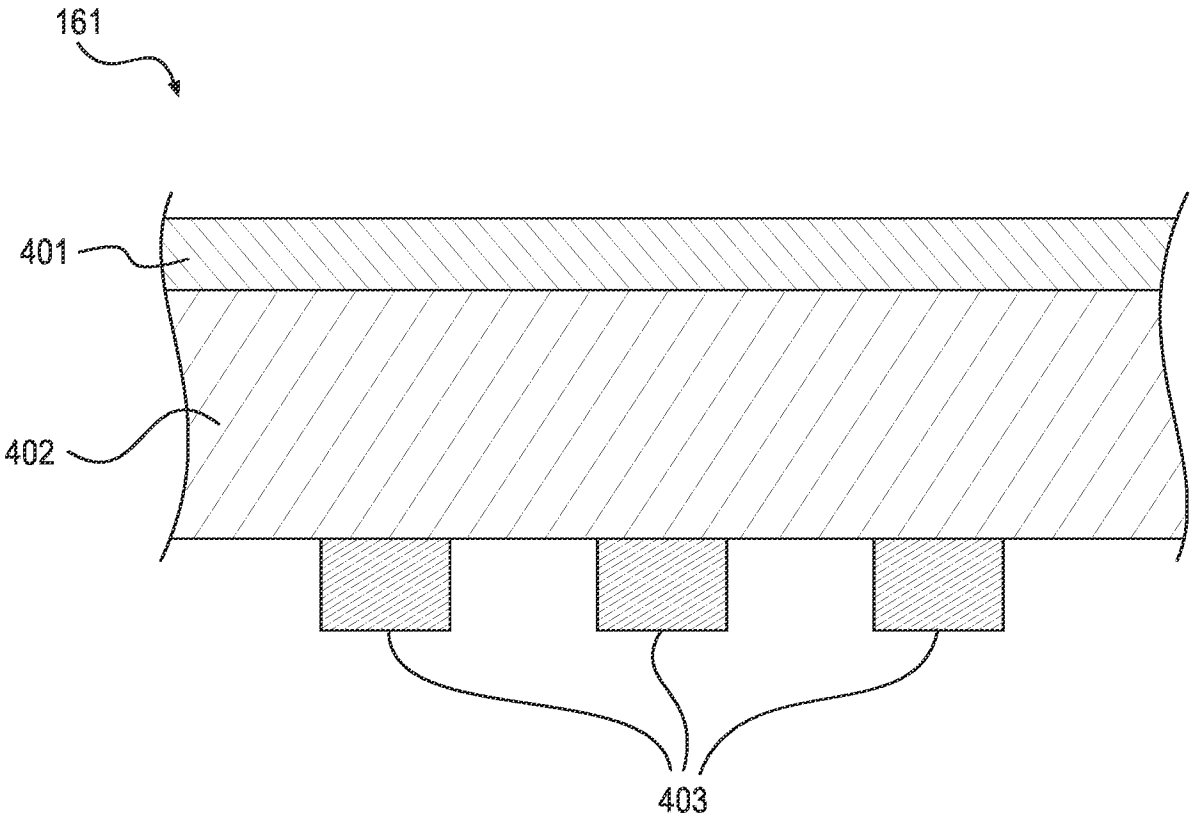
FIG. 4 is a view illustrating the layers of a protection structure of the head-protection component.
Figure 5:
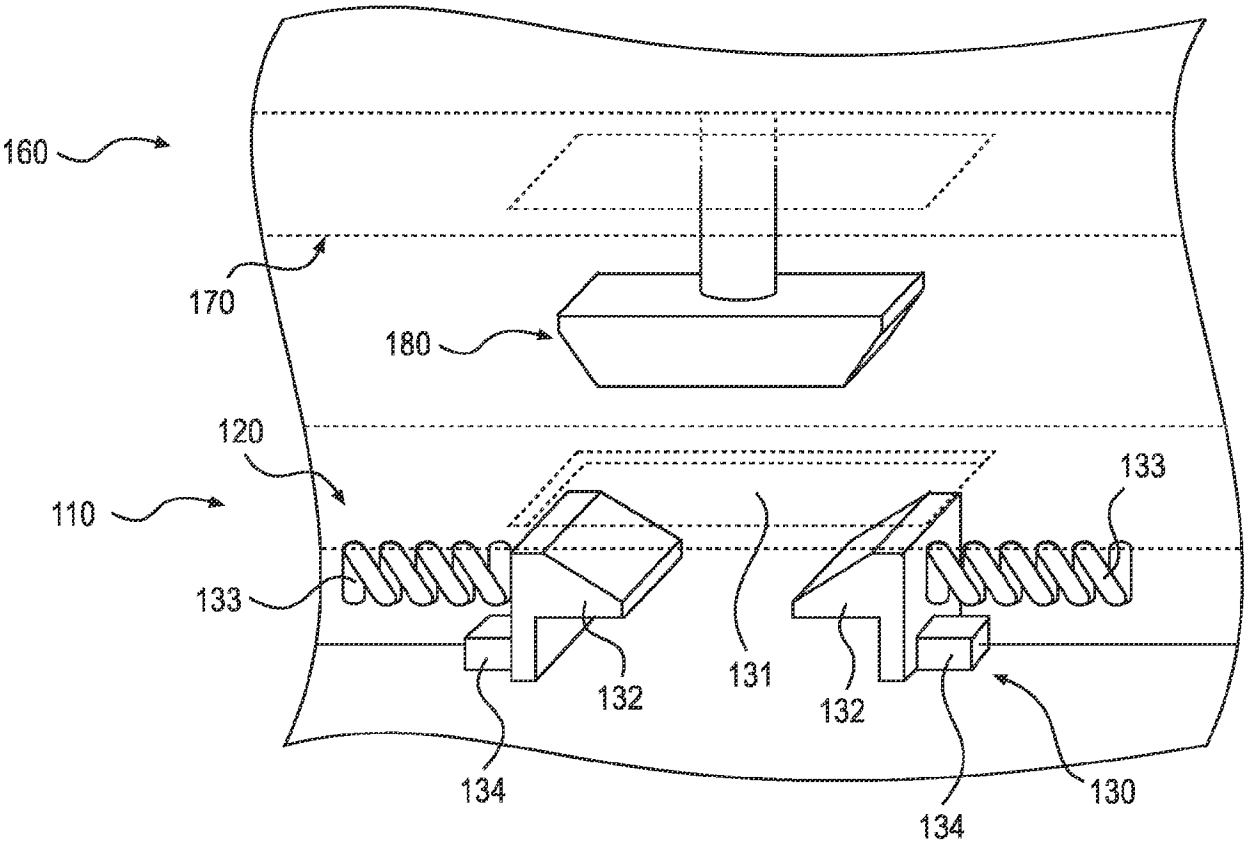
FIG. 5 is a side view illustrating the connection of the head-protection component and the frame component.

FIGS. 1 through 5 depict a helmet in accordance with a first embodiment of the invention. FIG. 1 depicts the helmet having its components in an assembled or attached state, while FIG. 2 depicts the helmet in a disassembled or detached state. FIG. 3 depicts frame component 110 from an overhead view. FIG. 4 depicts the layers of a protection structure. FIG. 5 illustrates the connection of the components.

Helmet 100 includes a head-protection component 160 and the frame component 110. Helmet 100 is formed by attaching head-protection component 160 to frame component 110.

Frame component 110 includes a frame structure 111 having an upward connection surface 120, chin strap connectors 112 for attaching a chin strap 113, a facemask 114, and a detachment control 140 (shown in FIG. 3). In the preferred embodiment, frame component 110 forms a bottom base of assembled helmet 100.

The head-protection component 160 includes a protection structure 161 having a downward connection surface 170. This protection structure is made from a deformable impact distributing material that disburses the forces of impact. The material thus absorbs such forces rather than transmitting such forces to the head of the wearer, which is the case for helmets having a hard or rigid shell. Head-protection component 160 includes connectors 180 provided on its downward connection surface 170. Frame component 110 includes connectors 130 provided on its upward connection surface 120. When head-protection component 160 is attached to frame component 110, upward connection surface 120 and downward connection surface 170 contact each other. Connectors 180 on head-protection component 160 complement the corresponding connectors 130 on frame component 110, allowing head-protection component 160 to be fitted to frame component 110.

When head-protection component 160 is attached to frame component 110, the respective connectors 130 and 180 latch together to provide a locking fit, ensuring that the components do not unintentionally detach from each other. When the components are attached to each other, the exterior boundary between the two components is preferably a flush surface. However, it can be appreciated that the surface may have a stepped, beveled, or other transition at the seam between the components to locate properly the two components together.

As previously mentioned, frame component 110 includes a detachment control 140. Detachment control 140, when activated, permits the detaching of connectors 180 from connectors 130, thereby detaching head-protection component 160 from frame component 110.

The present invention may be embodied as a football helmet. When playing in a football game, a player utilizing the present invention will customarily bring only a single frame component 110, but will bring multiple quantities of head-protection component 160. Prior to using the helmet, the player or, for example, his assistant, assembles helmet 100 by attaching one of the head-protection components 160 to frame component 110. The remaining quantities of head-protection components 160 are used as replacements, as will be further discussed.

During the game, the player may encounter a significant head impact. When this occurs, the head-protection component 160 on helmet 110 deforms, protecting the player's head from injury. After the impact, the deformed head-protection component 160 might no longer provide its original level of protection. Thus, the player or his assistant will detach the deformed head-protection component 160 from frame-component 110 and discard the deformed component. The player or his assistant will then retrieve a replacement head-protection component 160, which may be identical to the original component 160, and attach it to the frame component 110. At this point, the player may continue to play the game, but remains protected by the replaced head-protection component to the same extent as was provided by the original component.

FIG. 4 shows the features of protection structure 161. Protection structure 161 is preferably of in-molded construction. Protection structure 161 includes an outer layer 401, an absorption layer 402, and a comfort layer 403.

In a preferred embodiment, outer layer 401 is constructed of polycarbonate having a relatively small thickness of 1 mm. Outer layer 401 is a hard outer shell which provides resistance to less-severe impacts. Outer layer 401 may also be smooth, allowing logos or other graphics to be applied thereto.

Outer layer 401 is molded to absorption layer 402. In a preferred embodiment, absorption layer 402 is constructed of expanded polystyrene (EPS) having a thickness of 15 mm and a density of 80 g/l.

A comfort layer 403 is applied to the interior surface of absorption layer 402. In a preferred embodiment, comfort layer 403 is formed of polyurethane form, and is applied as strips or squares in intervals within the interior of structure 403. However, it can be appreciated that comfort layer 403 can be applied or shaped according to any alternative configuration which allows contact with the head.

The attachment features will now be described.

As previously mentioned, head-protection component 160 includes connectors 180, and frame component 110 includes connectors 130. In the first embodiment, connectors 180 are stationary hooks which protrude from connection surface 170 of head-protection component 160. In the preferred embodiment, each stationary hook 180 has two extended portions which are beveled or tapered for easier insertion into connector 130. However, it will be appreciated that each stationary hook 180 may have greater than two extended portions or less than two extended portions, and may be shaped in any appropriate form, so long as it can be inserted into connector 130.

Each connector 130 includes a receiving slot 131 which is integrated with connection surface 120 of frame component 110. Each connector 130 also includes a spring-loaded mechanism which mates with a respective stationary hook 180. Each stationary hook 180 is inserted into a respective receiving slot 131 and couples with the spring-loaded mechanism.

The spring-loaded mechanism includes at least one retractable latch 132, at least one spring 133, and at least one retraction mechanism 134. Each retractable latch 132 retains a horizontally-extending portion of stationary hook 180. In a preferred embodiment, retractable latch 132 is beveled or tapered to facilitate acceptance of the stationary hook 180. Each spring 133 provides a spring force which biases a respective latch 134 in an extended (i.e., latched) position. Each retraction mechanism 134 retracts a corresponding retractable latch 132 from its biased extended position to a retracted (i.e., unlatched) position.

In a preferred embodiment as shown in FIG. 5, connector 130 includes two retractable latches 132, and a spring 133 and retraction mechanism 134 corresponding to each retractable latch 132. However, it will be appreciated that any quantity of retractable latches may be used, and that multiple springs or retraction mechanisms could potentially correspond to a single retractable latch.

The spring-loaded mechanism is mechanically coupled to detachment control 140, which is adapted to control a mechanical state of the spring-loaded mechanism, specifically the position of the retractable latch 132. By default, detachment control 140 is in a deactivated position. In this state, retractable latch 132 is in its biased extended position, with each latch 132 being extended and retaining an inserted stationary hook 180.

When detachment control 140 is activated, retractable latch 132 switches to the retracted position against the spring force of a respective spring 133. At this point, retractable latch 132 no longer retains an inserted stationary hook 180, allowing stationary hook 180 to be withdrawn from connector 130.

Detachment control 140 is preferably a button or a spring-biased switch, but may be any form of user interface capable of controlling each retraction mechanism 134 to retract each retractable latch 132. Detachment control 140 is also preferably a single interface which simultaneously controls all retraction mechanisms 134, but may alternatively include multiple interfaces which control less than all of the retraction mechanisms 134 in frame component 110.

In a preferred embodiment, frame component 110 and head-protection component 160 each include six of their respective connectors 130 and 180, as seen in the overhead view of frame component 110 in FIG. 3. Each component has two connectors in the front portion, two connectors in the rear portion, and one connector at each of the left and right portions. However, it will be appreciated that each of head-protection component 160 and frame component 110 may include more than six connectors or less than six connectors. It will also be appreciated that head-protection component 160 and frame component 110 do not necessarily require the same number of respective connectors, but that plural connectors on one component could mate with a single connector on the other component.

Second Embodiment

Figure 6:
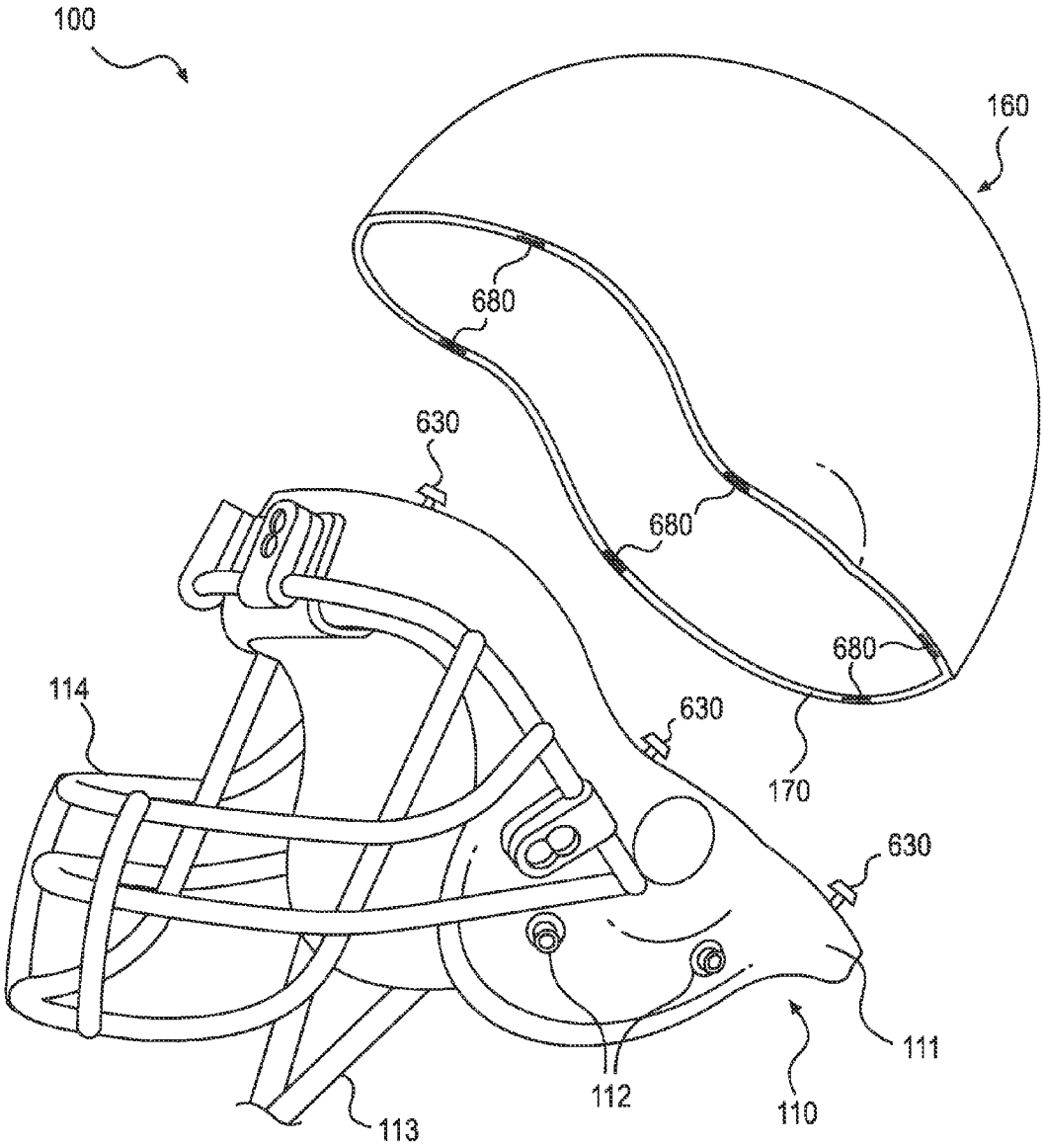
FIG. 6 is a side view of a helmet in accordance with a second embodiment of the present invention.

FIG. 6 depicts a helmet in accordance with a second embodiment of the present invention. In the second embodiment, the placement of hooks and slots are reversed, with respect to frame component 110 and head-protection component 160. Unless indicated otherwise, reference numerals which were previously described with respect to the first embodiment are used herein to describe similar features in the second embodiment.

As seen in FIG. 6, frame component 110 includes connectors 630 as stationary hooks protruding from upward connection surface 120. Head-protection component 160 includes connectors 680 as receiving slots integrated with downward connection surface 170. In this case, a detachment control is preferably provided on head-protection component 160 instead of frame component 110.

Third Embodiment

Figure 7:
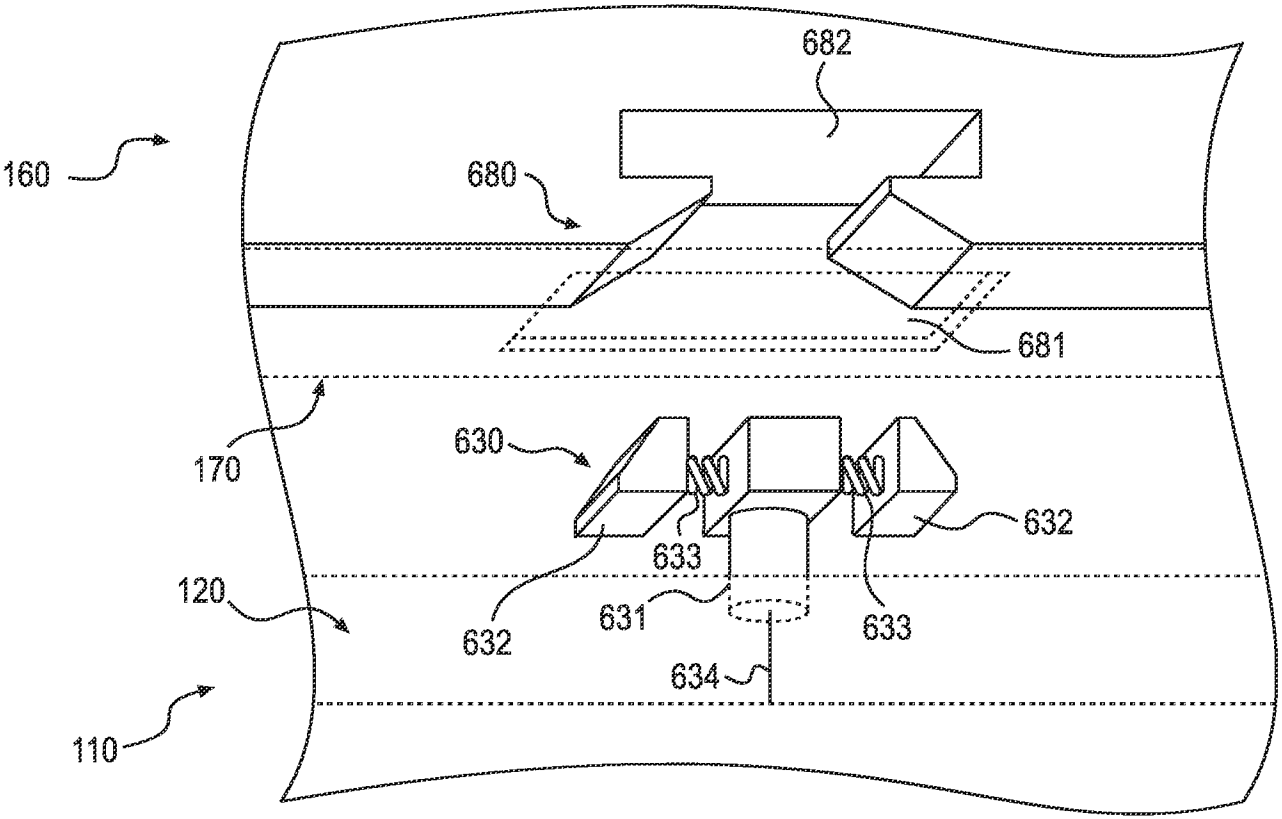
FIG. 7 is a side view illustrating the connection of the head-protection component and the frame component in accordance with a third embodiment of the present invention.

FIG. 7 depicts a helmet configuration in accordance with a third embodiment of the present invention. The third embodiment is similar to the second embodiment, except that the hooks, instead of the latches, contain the spring-loaded retractable mechanism to detach head-protection component 160 from frame component 110.

As seen in FIG. 7, frame component 110 still includes connectors 630 as stationary hooks protruding from upward connection surface 120. However, in this embodiment, connector 630 includes a hook base 631 protruding from upward connection surface 120, two retractable hook ends 632 extending from hook base 631, and a spring 633 corresponding to each retractable hook end 632. Connector 630 also includes a retraction mechanism 634 for retracting one or more retractable hook ends 632 from a biased extended position to a retracted position. In this embodiment, two hook ends 632 are depicted. However, it will be appreciated that any quantity of retractable hook ends may be used, and that multiple springs or retraction mechanisms could potentially correspond to a single retractable hook end.

Meanwhile, connector 680 on head-protection component 160 includes a receiving slot 681 on connection surface 170, and a latch 682. Unlike the second embodiment, latch 682 in this embodiment is not spring-loaded. Latch 682 is preferably tapered in its outer receiving surfaces to facilitate the insertion of connector 630, and contains a cavity to accommodate connector 630 having extended hook ends 632.

The spring-loaded mechanism in connector 630 is mechanically coupled to detachment control 140, which is adapted to control a mechanical state of the spring-loaded mechanism, specifically the position of the retractable hook end 632. By default, detachment control 140 is in a deactivated position. In this state, retractable hook end 632 is in its biased extended position, with each hook end 632 being extended. The cavity of latch 682 retains connector 630 while hook ends 632 are in the extended position.

When detachment control 140 is activated, retractable hook end 632 switches to the retracted position against the spring force of a respective spring 633. At this point, latch 682 no longer retains hook end 632, allowing connector 630 to be withdrawn from connector 680.

As with the previous embodiments, detachment control 140 is preferably a button or a spring-biased switch, but may be any form of user interface capable of controlling each retraction mechanism 634 to retract each retractable hook end 632. Detachment control 140 is also preferably a single interface which simultaneously controls all retraction mechanisms 634, but may alternatively include multiple interfaces which control less than all of the retraction mechanisms 634 in frame component 110.

It can further be appreciated that the use of a retractable hook end and non-retractable latch is not necessarily limited to this embodiment, but can also be applied to the first embodiment and/or any other applicable embodiments.

Alternative Embodiments

It will be appreciated that connectors 130 and 180 are not limited to stationary hooks and corresponding receiving slots, but may be any connection mechanism that detachably secures head-protection component 160 to frame component 110.

Additionally, while helmet 100 is depicted as a football helmet in the first and second embodiments, it can be appreciated that the present invention may extend to any other sport or activity that requires head protection. Furthermore, the present invention may also extend to protection equipment for body parts other than the head.

In the foregoing description, example aspects of the present invention are described with reference to specific example embodiments. Despite these specific embodiments, many additional modifications and variations would be apparent to those skilled in the art. Thus, it is to be understood that example embodiments of the invention may be practiced in a manner other than those specifically described. Accordingly, the specification is to be regarded in an illustrative rather than restrictive fashion. It will be evident that modifications and changes may be made thereto without departing from the broader spirit and scope.

Similarly, it should be understood that the figures are presented solely for example purposes. The architecture of the example embodiments presented herein is sufficiently flexible and configurable such that it may be practiced in ways other than that shown in the accompanying figures.

Furthermore, the purpose of the foregoing abstract is to enable the U.S. Patent and Trademark Office, the general public, and scientists, engineers, and practitioners in the art who are unfamiliar with patent or legal terms or phrases, to quickly determine from a cursory inspection the nature and essence of the technical disclosure of the application. The abstract is not intended to limit the scope of the present invention in any way. It is also to be understood that the processes recited in the claims need not be performed in the order presented.

What is claimed is:

1. A method of using a helmet, comprising:

attaching a first crown portion to a frame portion of a helmet, by mating at least one connector on the first crown portion with at least one connector on the frame portion, the frame portion including a facemask;

detaching the first crown portion from the frame portion, wherein a user control un-mates the at least one connector of the first crown portion from the at least one connector of the frame portion; and attaching a second crown portion to the frame portion, by mating at least one connector on the second crown portion with the at least one connector on the frame portion, wherein the frame portion forms a bottom base of the helmet and each crown portion forms a top crown of the helmet such that each crown portion is supported on top of the frame portion when attached thereto, wherein each of the first and second crown portions has a cross-section comprising (i) a layer formed of polycarbonate, and (ii) an absorption layer formed of expanded polystyrene, wherein the cross-sectional arrangement of the frame portion differs from the crown portions, and wherein the frame portion defines an edge portion, which defines a passage through which a user's head is adapted to be received.

2. The method of claim 1, wherein the first crown portion is identical to the second crown portion.

3. The method of claim 1, wherein (i) the layer formed of polycarbonate is an outer layer, (ii) each crown portion further comprises an inner layer, and (iii) the edge portion is a 360° continuous edge portion.

4. The method of claim 3, wherein the inner layer is formed of polyurethane.

5. The method of claim 1, wherein each crown portion is formed as an in-molded structure.

6. The method of claim 1, wherein the frame portion includes a facemask and a chin strap.

7. The method of claim 1, wherein the absorption layer has a density of 80 g/l.

8. A method of using a helmet, comprising:

attaching a first crown portion to a frame portion of a helmet, the frame portion including a facemask;

detaching the first crown portion from the frame portion; and attaching a second crown portion to the frame portion, wherein the frame portion forms a bottom base of the helmet and each crown portion forms a top crown of the helmet such that each crown portion is supported on top of the frame portion when attached thereto, wherein each of the first and second crown portions has a cross-section comprising (i) an outer shell, and (ii) an absorption layer, wherein the cross-sectional arrangement of the frame portion differs from the crown portions, and wherein the frame portion defines an edge portion, which defines a passage through which a user's head is adapted to be received.

9. The method of claim 8, wherein the first crown portion is identical to the second crown portion.

10. The method of claim 8, wherein (i) the outer layer is formed of polycarbonate, (ii) each crown portion further comprises an inner layer, and (iii) the edge portion is a 360° continuous edge portion.

11. The method of claim 8, wherein the inner layer is formed of polyurethane.

12. The method of claim 8, wherein each crown portion is formed as an in-molded structure.

13. The method of claim 8, wherein the frame portion includes a facemask and a chin strap.

14. The method of claim 8, wherein the absorption layer has a density of 80 g/l.

* * * * *